United States Patent [19]

Osborne

[11] 4,419,549

[45] Dec. 6, 1983

[54] OPERATING MECHANISM FOR AN ELECTRIC SWITCH

[75] Inventor: Anthony Osborne, Duluth, Ga.

[73] Assignee: Kearney-National, Inc., Atlanta, Ga.

[21] Appl. No.: 375,728

[22] Filed: May 7, 1982

[51] Int. Cl.[3] ..... H01H 9/20

[52] U.S. Cl. ..... 200/50 A

[58] Field of Search ..... 200/50 A, 50 AA

[56] References Cited

U.S. PATENT DOCUMENTS

| | | | |
|---|---|---|---|
| 1,983,902 | 12/1934 | Hanny | 200/50 A |
| 3,578,925 | 5/1971 | Drown et al. | 200/50 AA |
| 3,876,847 | 4/1975 | Dykes et al. | 200/50 A X |
| 4,006,121 | 2/1977 | Isono | 200/50 A X |
| 4,137,433 | 1/1979 | Erickson et al. | 200/50 A |

*Primary Examiner*—J. R. Scott

*Attorney, Agent, or Firm*—Rodgers & Rodgers

[57] ABSTRACT

For initiating operating movement to an electric switch disposed in a housing having an access door, a movable element is interconnected with the switch and operating movement is imparted thereto by motivating means, and interlocking means is mounted on the housing and arranged to prevent switch closing movement of the motivating means so long as the access door of the housing is open.

10 Claims, 9 Drawing Figures

OPERATING MECHANISM FOR AN ELECTRIC SWITCH

TECHNICAL FIELD

This invention relates to a switch operating mechanism for operating an electric switch disclosed in a housing having an access door. Preferably the switch operating mechanism is mounted on the switch housing but, if desired, may be disposed at some location remote from the switch and housing.

BACKGROUND ART

U.S. Pat. No. 4,302,646 issued Nov. 24, 1981 for Electric Switch and Operating Mechanism Therefor and which is assigned to the assignee of this invention discloses an electric switch operated by a torsion bar and wherein the torsion bar is rotated by a manually operable crank. In this arrangement, the location of the manually operable crank is predetermined and may not always be positioned in a convenient location for one reason or another.

DISCLOSURE OF THE INVENTION

According to this invention in one form, a switch of the type disclosed in and covered by U.S. Pat. No. 4,302,646 may be controlled by mechanism conveniently mounted on the switch housing and which is provided with safety features whereby the switch itself may not be closed if the access door of the switch housing is open due to the action of interlock means formed according to one aspect of this invention. If desired the switch may be locked in its closed or open positions by manually controlled security locking means and when the switch is in closed position, a locking element movably mounted on the motivating means may be employed so as effectively to lock the access door of the housing in closed position when the switch is closed. Also an over center toggle feature may be employed in connection with the locking element so as to hold the locking element in positions corresponding respectively to the closed and open positions of the switch.

BEST MODE OF CARRYING OUT THE INVENTION

Figure 1:
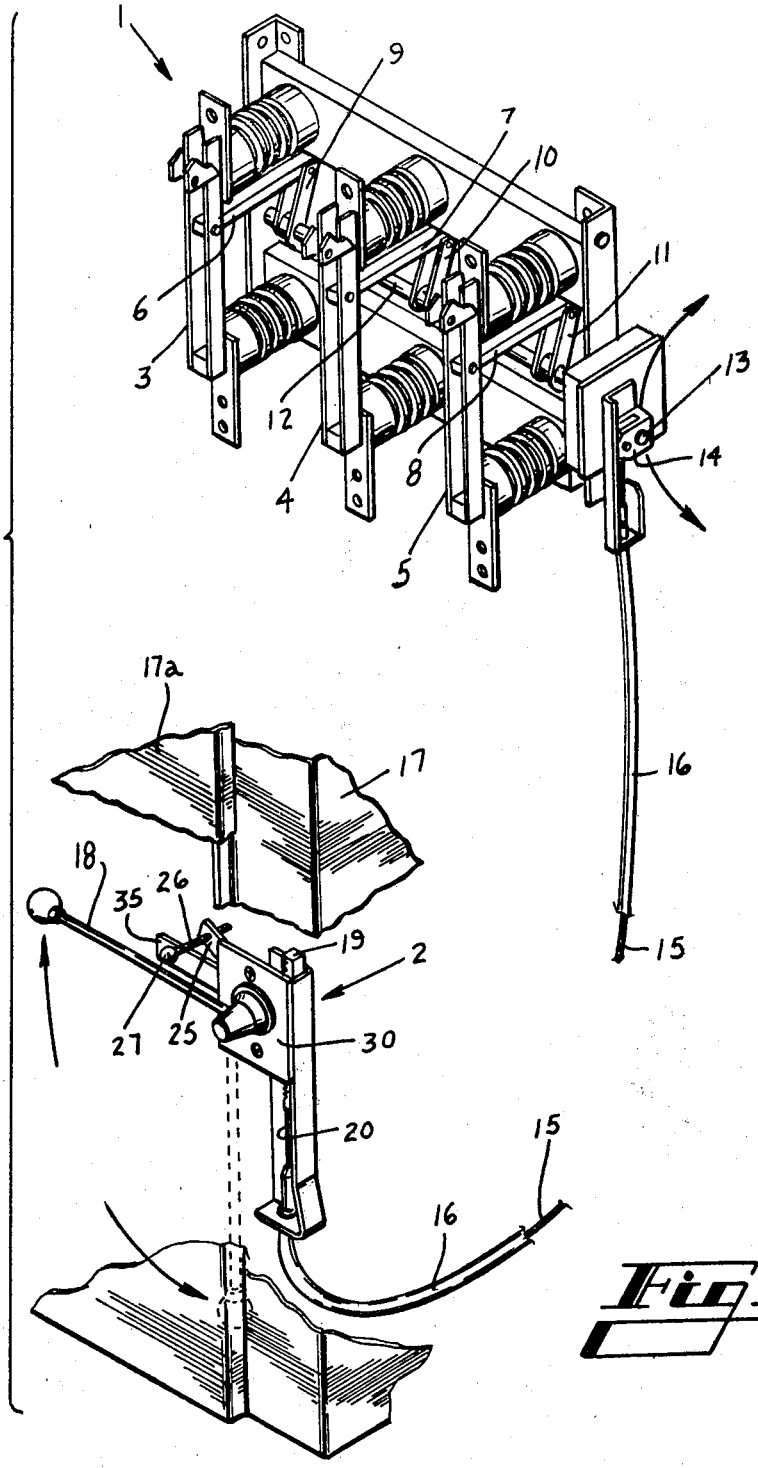
FIG. 1 is an overall perspective view of a switch constructed according to U.S. Pat. No. 4,302,646 and an associated operating mechanism formed according to this invention.

With reference to FIG. 1 the numeral 1 generally designates an electric switch of the type disclosed and claimed in U.S. Pat. No. 4,302,646 while the numeral 2 generally designates a switch operating mechanism formed according to this invention.

Briefly the switch 1 comprises pivotally mounted switch blades 3, 4 and 5 which are operated by links 6, 7 and 8 which in turn are reciprocated by cranks 9, 10 and 11. These cranks 9–11 are rotated by a tubular element 12 which in turn is rotated by an internal torsion bar one end of which appears at 13. A crank 14 is secured to end 13 of the torsion bar and rotary movement is imparted to crank 14 by a reciprocable element 15 which is slidable within a sheath 16. The switch 1 and operating mechanism 2 are mounted within the housing 17 having an access door 17*a*. Operating handle 18, as is apparent from the drawings, is disposed outside the housing 17.

Figures 2, 2A:
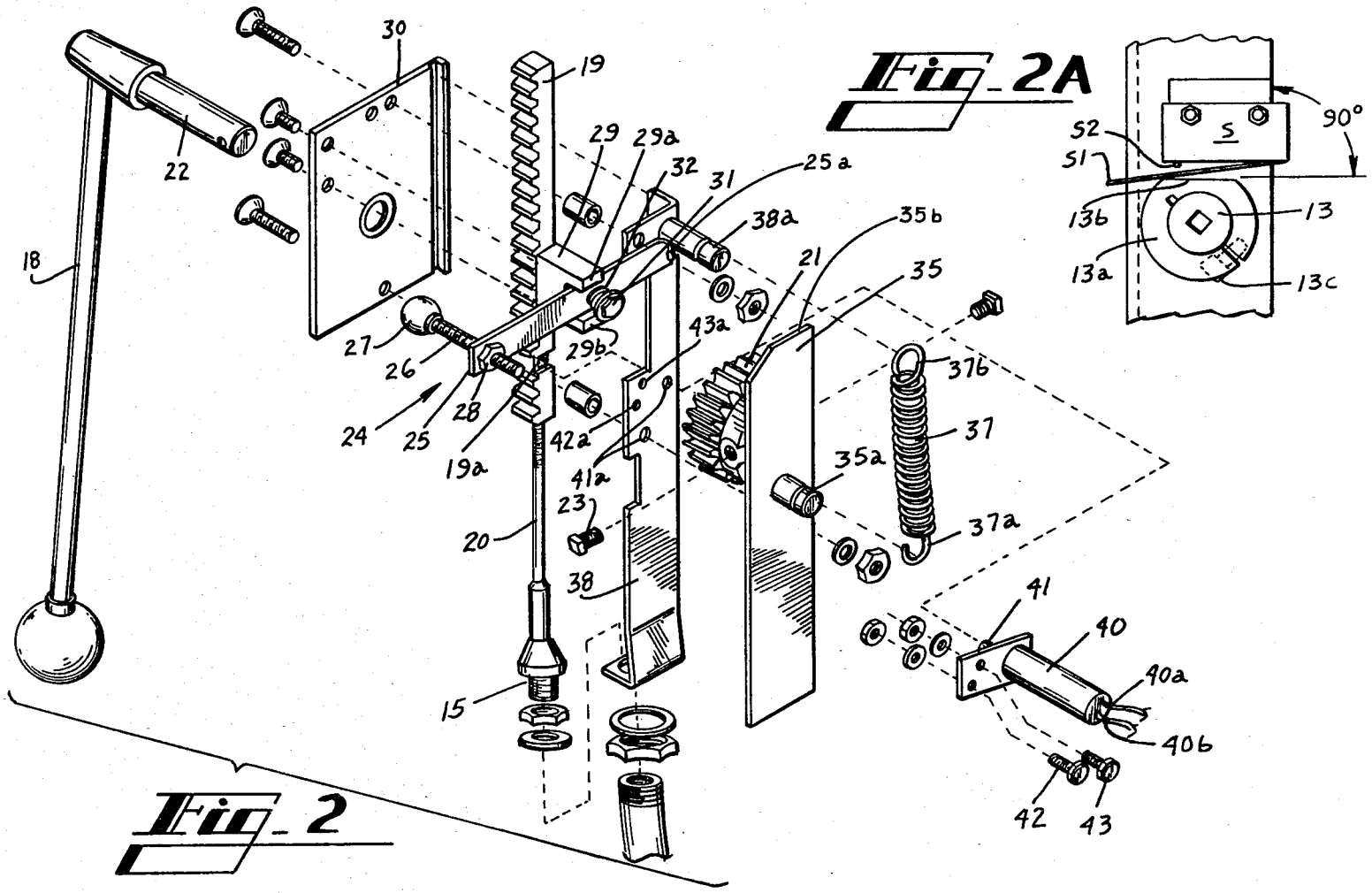
FIG. 2 is an exploded perspective view showing switch motivating means formed according to this invention.
FIG. 2*a* is an end view of a part of FIG. 1 as viewed from the left of FIG. 1.

As is best shown in FIGS. 1 and 2, reciprocable movement is imparted to the cable 15 by a rack 19 which is connected at its lower end with cable 15 by means of a rod 20 and reciprocable vertical movement is imparted to rack 19 by means of pinion 21 secured to shaft 22 by welding or by bolt 23. Thus rotation of handle 18 from the solid line position shown in FIG. 1 to the solid line position shown in FIG. 2 causes the switch to swing to its open position from its closed position. Of course reverse movement causes the switch to close.

In order to insure that the switch may not be closed if the access door 17*a* is open, lockout element generally indicated at 24 is provided and includes a lockout bar 25 to one end of which a lockout rod 26 secured by suitable means such as by nuts 28. Sphere 27 is mounted on rod 26. A mounting pedestal or support 29 is secured to plate 30 which is rigidly mounted on the housing 17 and a bolt 31 is mounted between the prongs 29*a* and 29*b* of support 29. A compression spring 32 is disposed about the bolt 31 so that the lockout bar 25 is effectively supported in a yieldable fashion. With the parts disposed as shown in FIG. 2, the horizontal position of bar 25 indicates that the access door 17*a* is open as is indicated for example in FIG. 4.

Formed on the right hand end of lockout bar 25 is an abutment surface 25*a*. For cooperating with abutment surface 26*a* and thereby to lock the switch motivating means shown in FIG. 2 against closing movement of the switch, locking element 35 is rigidly secured to pinion 21 and thus is rotatable therewith.

Figure 4:
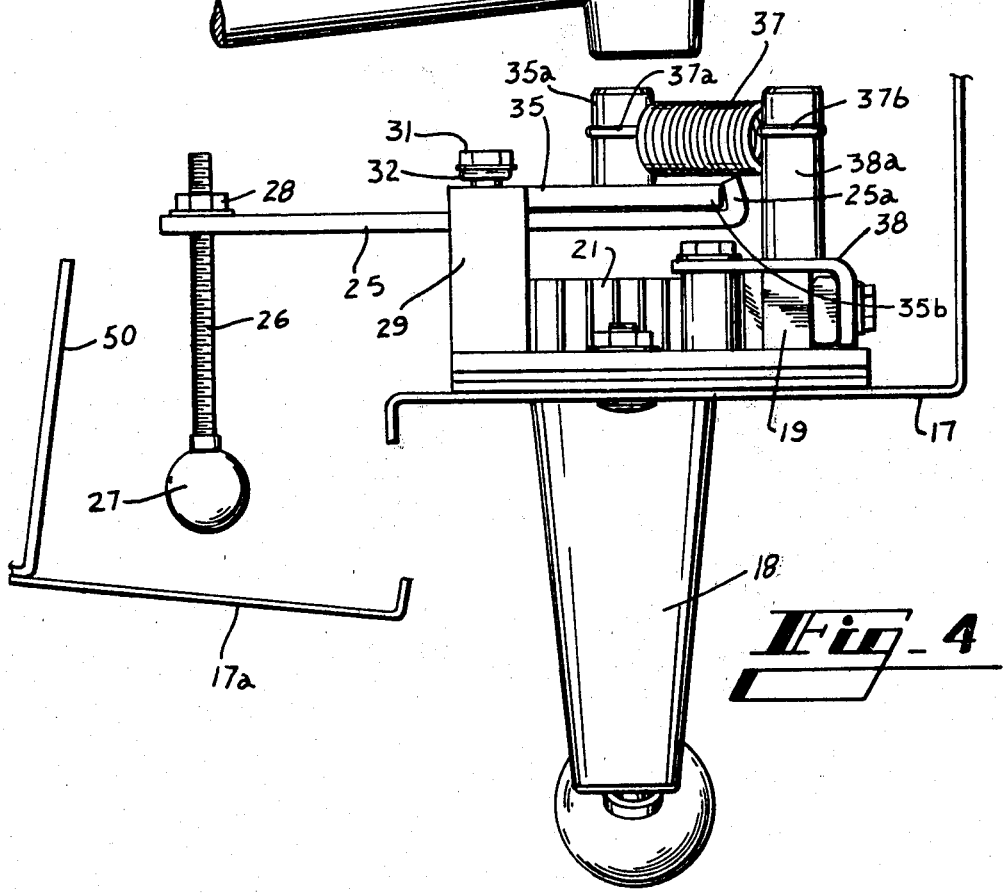
FIG. 4 is a view similar to FIG. 3 and which shows the interlocking means in a position of disengagement from the open access door in which position closing of the switch is prevented.
Figure 6:
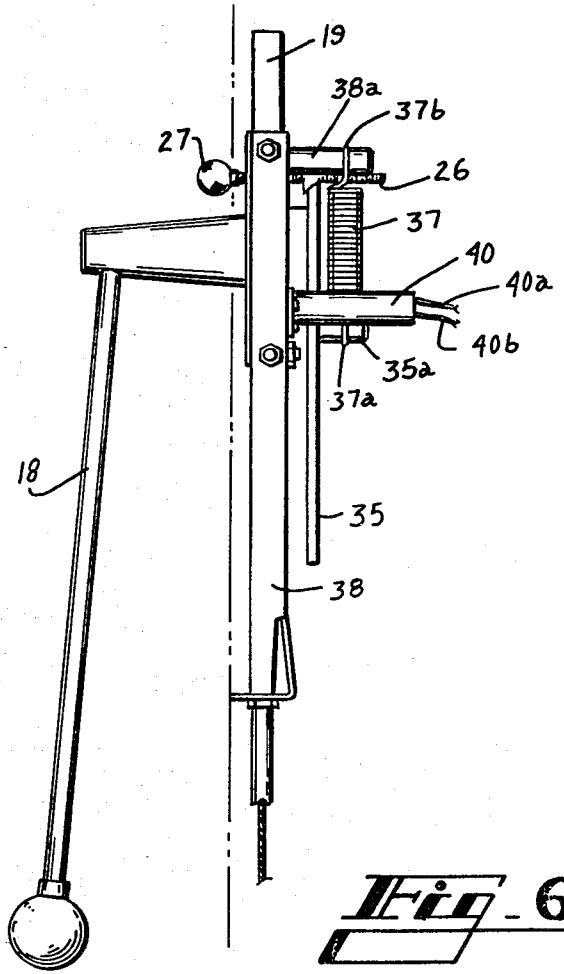
FIG. 6 is a view similar to FIG. 5 and shows the parts in the switch open position.

With the parts shown in the positions represented in FIGS. 2 and 4, the access door 17*a* is open and the motivating mechanism is locked against switch closing movement due to engagement of the upper end 35*b* with the abutment 25*a*. Under these conditions, it is impossible to rotate the operating handle 18 from the position shown in FIG. 2 to that shown in solid lines in FIG. 1. This safety feature constitutes an important aspect of this invention.

Figure 3:
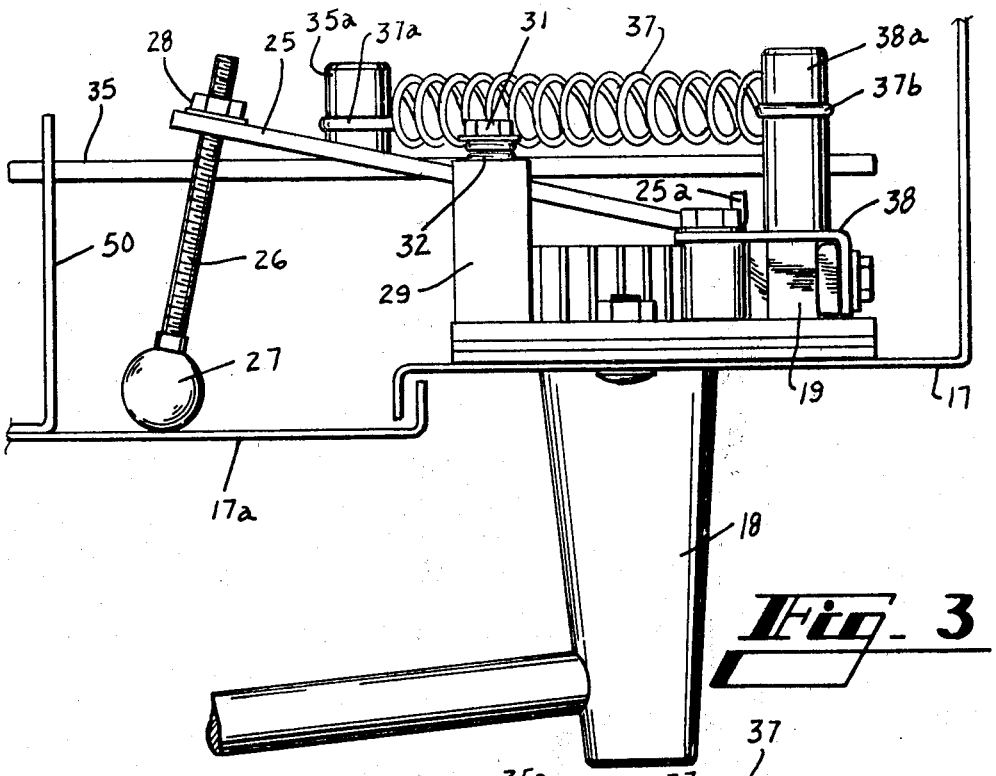
FIG. 3 is a view from above of motivating means formed according to this invention and the associated interlocking means arranged so as to cooperate with the housing access door to allow closing of the switch only when the access door is closed.

If, on the other hand, the access door 17*a* is closed as indicated in FIG. 3, the sphere 27, the bar 26 and the locking bar 25 are moved to the positions indicated in FIG. 3. When so situated, the locking end 25*a* of the locking bar 25 is out of engagement with the locking element 35 and it is thus possible to swing the arm 18 under the conditions represented in FIG. 3 to the closed position represented by solid lines in FIG. 1.

For the purpose of securing the locking element 35 in a position corresponding to the closed position or open position of the switch, an over center toggle structure is provided and comprises tension spring 37 which is secured at its lower end 37*a* with the pin 35*a* which is securely mounted on locking element 35. The upper end 37*b* of spring 37 is secured to pedestal 38*a* which is securely mounted on plate 38 which in turn is secured to plate 30 by suitable means such as by the bolts and nuts shown in exploded form in FIG. 2. Since pedestal 35*a* is spaced from the center of rotation of locking element 35 and of pinion 21 and since the pedestal 38*a* is fixed in position and according to one aspect of this invention, an over center toggle mechanism is thus formed whereby the biasing spring 37 holds the locking element 35 in a position corresponding to the closed or open position of the switch as the case may be.

If desired a further safety feature may be provided whereby operation of the motivating mechanism is prevented under certain conditions. Toward this end and as best shown in FIG. 2, a solenoid 40 having a plunger 41 is mounted by bolts 42 and 43 to the support plate 38. Bolt 42 is inserted into aperture 42*a* while bolt 43 is inserted into aperture 43*a* and plunger 41 reciprocates through aperture 41*a*. Plunger 41 cooperates with aperture 19*a* formed at the lower end of rack 19. When solenoid 40 is denergized, its plunger 41 is disposed within the aperture 19*a* and reciprocal movement of rack 19 is thus effectively prevented. In order to free the rack 19 for operating movement, it is simply necessary to energize by any suitable known means the solenoid 40 and thus to withdraw the plunger 41 from the aperture 19*a*.

Preferably solenoid 40 is electrically connected to an auxiliary switch S operated by the rotation of the main switch shaft 13 such that when the main switch 1 is closed the auxiliary switch S is open and the solenoid 40 cannot be energized to allow the switch to be opened without first deliberately providing other means of energizing the solenoid possibly in conjunction with other connected switchgear. As is shown in FIG. 2*a*, a cam 13*a* having a chordal surface 13*b* is secured to shaft 13 by set screw 13*c* and surface 13*b* is arranged to swing switch contact S1 into engagement with fixed contact S2 when switch 1 is opened due to clockwise rotation of shaft 13 as viewed in FIG. 2*a*.

Figure 5:
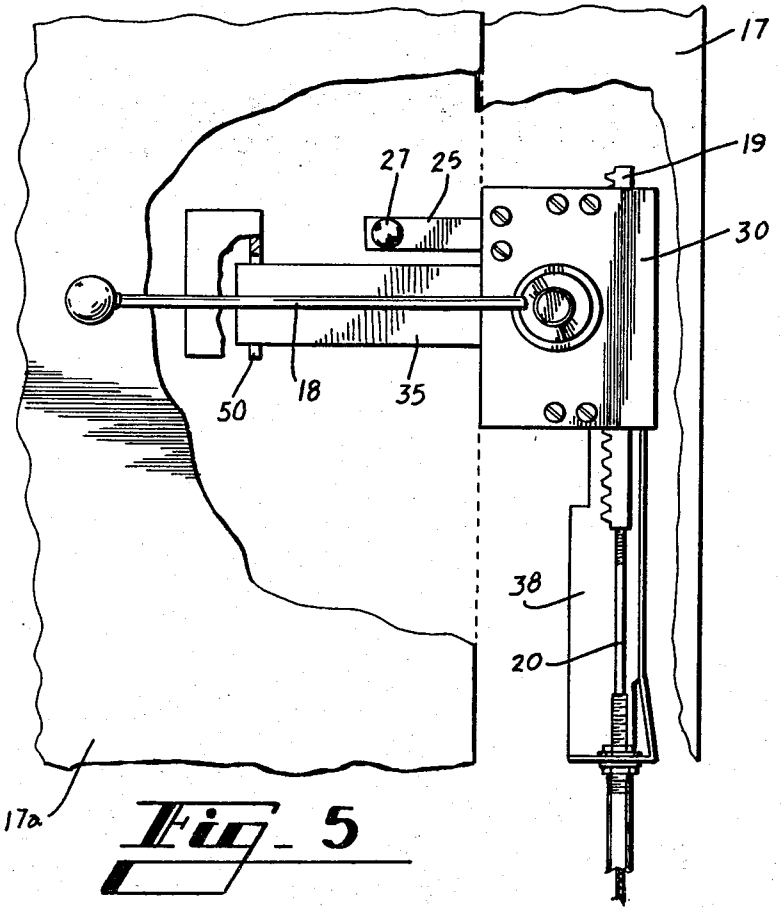
FIG. 5 is a view similar to the operating mechanism shown in FIG. 1 and which shows the parts in the switch closed position.
Figure 8:
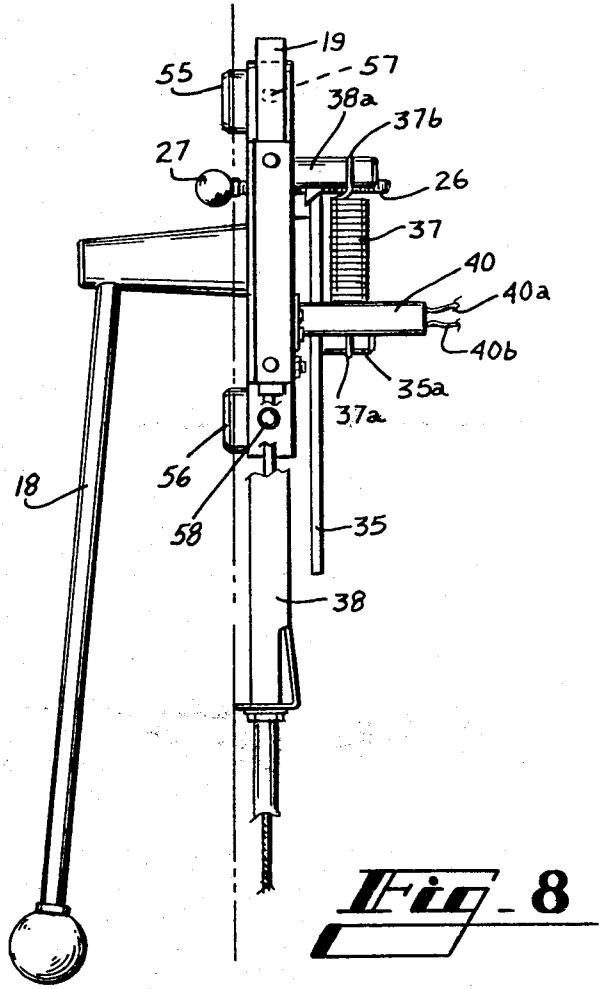
FIG. 7 is a view similar to FIG. 5 and in addition shows manually controlled locking devices which cooperate with a part of the motivating mechanism so as to lock the switch in either its closed or open position and FIG. 8 is a view similar to FIG. 6 and which shows the mechanism of FIG. 7 when disposed in the switch open position.

For the purpose of effectively locking the access door 17*a* in the closed position when the switch and door are closed, the structure best shown in FIG. 5 may be employed in accordance with one facet of this invention. As is shown in FIG. 5, the locking element 35 is shown disposed between the front panel of access door 17*a* and the door locking element 50 which is secured to the inner surface of access door 17*a*. Thus with the parts in the positions as shown in FIG. 5, locking element 35 securely holds the door 17*a* in closed position. Of course under these conditions the switch is closed.

Also as is evident from FIG. 5 the handle may serve as an effective means for locking the door 17*a* since the handle 18 is in the horizontal position when the switch is closed. Obviously handle 18 is disposed outside the access door 17*a* and thus effectively locks that access door closed when the switch is closed.

Figure 7:
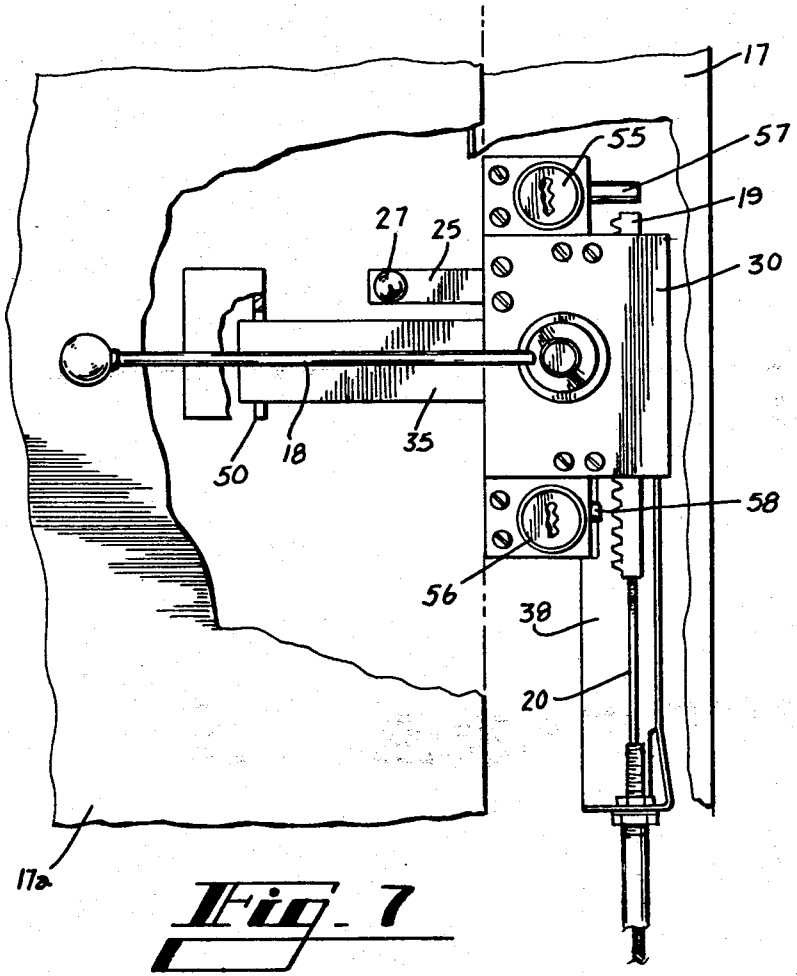

As is best shown in FIG. 7, a further means may be provided in the form of manually controlled locking devices indicated generally by the numerals 55 and 56. These elements preferably are controlled by manually operable keys and are provided respectively with plungers 57 and 58. Thus as is shown in FIG. 7 location of the plunger 57 above the rack 18 effectively precludes upward movement of rack 18 and thus constitutes a further security feature according to one aspect of this invention. In similar fashion if the plunger 58 is operated to its outer position toward the right to occupy a position underneath the lower end of rack 18, downward movement of the rack is thus effectively precluded. By the means best shown in FIG. 7, knowledgeable and experienced personnel may be effectively utilized so as to provide an additional element of safety for a switch operating mechanism formed according to one aspect of this invention.

INDUSTRIAL APPLICABILITY

The switch operating mechanism formed according to this invention is preferably employed by direct mounting on the switch housing although the invention obviously is not limited to such an application and may be arranged so that the motivating mechanism is disposed at a distance from the switch itself. When placed on the same enclosure, no special alignment between the operating mechanism and the switch is required and the interlocking safety features formed according to this invention render the device particularly suitable for use in underground distribution systems serving subdivisions, shopping centers, industrial parks and the like.

I claim:

1. An operating mechanism for an electric switch disposed in a housing having an access door, said operating mechanism comprising a movable element interconnected with the switch for imparting operating movement thereto, motivating means including a rotatable pinion and an associated reciprocable rack for imparting operating movement to said movable element, and interlocking means including a locking element secured to said pinion and a yieldably mounted locking bar having a part engageable with said locking element and having another part engageable with said door, said locking bar being arranged to engage said locking element so as to prevent switch closing movement of said motivating means so long as said access door is open.

2. A switch operating mechanism according to claim 1 wherein said locking bar is movably supported by said housing.

3. A switch operating mechanism according to claim 2 wherein said locking bar includes yieldable biasing means arranged to urge said lockout element toward engagement with said access door.

4. A switch operating mechanism according to claim 1 wherein biasing means is interconnected between said locking element and said housing to form an overcenter toggle relation therewith.

5. A switch operating mechanism according to claim 1 wherein a biasing spring is connected at one end with said rotatable locking element at a point thereon which is spaced from the center of rotation of said rotatable locking element and at the other end with a fixed point on said housing.

6. A switch operating mechanism according to claim 5 wherein said spring and said rotatable locking element from an overcenter toggle arranged to bias said rotatable locking element into extreme positions corresponding to open and closed positions of the switch.

7. A switch operating mechanism according to claim 1 wherein said motivating means includes a reciprocably movable element having an aperture therein and wherein a solenoid and associated plunger are arranged with said plunger disposed in said aperture when said solenoid is not energized thereby to prevent operation of the mechanism.

8. A switch operating mechanism according to claim 1 wherein a pair of manually controlled locking devices separate from said interlocking means are fixedly mounted on said housing and arranged so as to engage a part of said motivating means when the switch is closed or open so as effectively to lock the switch in a closed or open position respectively.

9. A switch operating mechanism according to claim 1 wherein a door locking element is secured to the inner surface of said door and arranged for engagement by said locking element when said access door is closed thereby to lock said access door in closed position.

10. A switch operating mechanism according to claim 1 wherein a rotatable operating handle disposed outside said access door is arranged to impart operating movement to said motivating means and wherein said operating handle is disposed to engage said access door when the switch is closed so as to prevent opening of said access door when the switch is closed.

* * * * *